US008886441B2

(12) United States Patent
Dölker

(10) Patent No.: US 8,886,441 B2
(45) Date of Patent: Nov. 11, 2014

(54) METHOD FOR THE OPEN-LOOP CONTROL AND CLOSED-LOOP CONTROL OF AN INTERNAL COMBUSTION ENGINE

(75) Inventor: Armin Dölker, Friedrichshafen (DE)

(73) Assignee: MTU Friedrichshafen GmbH, Friedrichshafen (DE)

( * ) Notice: Subject to any disclaimer, the term of this patent is extended or adjusted under 35 U.S.C. 154(b) by 236 days.

(21) Appl. No.: 13/503,580

(22) PCT Filed: Oct. 19, 2010

(86) PCT No.: PCT/EP2010/006382

§ 371 (c)(1),
(2), (4) Date: May 11, 2012

(87) PCT Pub. No.: WO2011/047833

PCT Pub. Date: Apr. 28, 2011

(65) Prior Publication Data

US 2012/0221226 A1 Aug. 30, 2012

(30) Foreign Application Priority Data

Oct. 23, 2009 (DE) ..... 10 2009 050 468

(51) Int. Cl.

| | |
|---|---|
| ***F02D 41/22*** | (2006.01) |
| ***F02D 41/38*** | (2006.01) |
| ***F02D 41/14*** | (2006.01) |
| *F02D 41/24* | (2006.01) |
| *F02D 41/20* | (2006.01) |

(52) U.S. Cl.

CPC ..... *F02D 41/222* (2013.01); *F02D 41/1401* (2013.01); *F02D 41/3845* (2013.01); *F02D 41/3863* (2013.01); *F02D 41/2422* (2013.01); *F02D 2041/2027* (2013.01); *F02D 2041/223* (2013.01); *F02D 2041/227* (2013.01); *F02D 2200/0604* (2013.01)

USPC ..... 701/103; 123/198 D; 123/458

(58) Field of Classification Search

CPC ..... F02D 41/222; F02D 41/3845; F02D 41/3846; F02D 2041/222; F02D 2041/223; F02D 2041/227

USPC ..... 123/198 D, 456, 458, 447, 457; 701/103, 107

See application file for complete search history.

(56) References Cited

U.S. PATENT DOCUMENTS 5,937,826 A * 8/1999 Olson et al. ..... 123/447
6,053,147 A 4/2000 Hemmerlein et al.

(Continued)

FOREIGN PATENT DOCUMENTS

DE 19626689 C1 11/1997
DE 10155247 B4 8/1998

(Continued)

*Primary Examiner* — Thomas Moulis
*Assistant Examiner* — Elizabeth Hadley
(74) *Attorney, Agent, or Firm* — Lucas & Mercanti, LLP; Klaus P. Stoffel

(57) ABSTRACT

The invention relates to a method for the open-loop control and the closed-loop control of an internal combustion engine (1), the rail pressure (pCR) being controlled in a closed loop mode in the normal operating state and an emergency operation mode being activated once a defective rail pressure sensor (9) is detected, in which emergency operation the rail pressure (pCR) is controlled in an open loop mode. The invention is characterized in that in the emergency operation mode, the rail pressure (pCR) is gradually increased until a passive pressure relief valve (11) is activated which redirects fuel from the rail (6) to the fuel tank (2) when it is open.

5 Claims, 9 Drawing Sheets

(56) References Cited

U.S. PATENT DOCUMENTS

| | | | | |
|---|---|---|---|---|
| 6,283,108 | B1 * | 9/2001 | Matsufuji et al. | 123/690 |
| 6,578,553 | B1 | 6/2003 | Schubert et al. | |
| 6,712,047 | B2 | 3/2004 | Rueger | |
| 6,888,331 | B2 | 5/2005 | Serrano | |
| 6,948,480 | B2 | 9/2005 | Eser et al. | |
| 7,010,415 | B2 * | 3/2006 | Dolker | 701/107 |
| 7,025,028 | B2 * | 4/2006 | Dolker | 123/179.17 |
| 7,240,667 | B2 * | 7/2007 | Dolker | 123/456 |
| 7,412,968 | B2 * | 8/2008 | Takayanagi et al. | 123/456 |
| 7,451,038 | B2 * | 11/2008 | Kosiedowski et al. | 701/103 |
| 7,552,716 | B2 * | 6/2009 | Osaki | 123/457 |
| 7,624,719 | B2 * | 12/2009 | Achleitner et al. | 123/456 |
| 7,775,102 | B2 | 8/2010 | Haerer | |
| 8,261,605 | B2 * | 9/2012 | Hermes et al. | 73/114.51 |
| 2002/0117150 | A1 * | 8/2002 | Sykes | 123/458 |
| 2004/0200456 | A1 * | 10/2004 | Eser et al. | 123/458 |
| 2011/0016959 | A1 | 1/2011 | Hermes et al. | |
| 2012/0215424 | A1 * | 8/2012 | Dolker | 701/104 |
| 2012/0226428 | A1 * | 9/2012 | Dolker | 701/103 |
| 2012/0255521 | A1 * | 10/2012 | Aoki et al. | 123/447 |
| 2012/0265424 | A1 * | 10/2012 | Dolker | 701/104 |
| 2013/0206109 | A1 * | 8/2013 | Dolker et al. | 123/456 |

FOREIGN PATENT DOCUMENTS

| | | | |
|---|---|---|---|
| DE | 19800760 | A | 8/1998 |
| DE | 19731201 | | 1/1999 |
| DE | 19916100 | | 10/2000 |
| DE | 10003298 | | 8/2001 |
| DE | 10014737 | | 10/2001 |
| DE | 10157641 | | 6/2003 |
| DE | 10157641 | A1 | 6/2003 |
| DE | 102004037963 | A1 | 3/2006 |
| DE | 102004061474 | | 6/2006 |
| DE | 102006009068 | A1 | 8/2007 |
| DE | 102006040441 | A | 2/2008 |
| DE | 102008000983 | | 10/2009 |
| EP | 0899442 | | 3/1993 |
| EP | 1446868 | A1 | 8/2004 |
| WO | 03046357 | Y | 6/2003 |

* cited by examiner

METHOD FOR THE OPEN-LOOP CONTROL AND CLOSED-LOOP CONTROL OF AN INTERNAL COMBUSTION ENGINE

The present application is a 371 of International application PCT/EP2010/006382, filed Oct. 19, 2010, which claims priority of DE 10 2009 050 468.0, filed Oct. 23, 2009, the priority of these applications is hereby claimed and these applications are incorporated herein by reference.

BACKGROUND OF THE INVENTION

The invention concerns a method for the open-loop and closed-loop control of an internal combustion engine, in which the rail pressure is controlled by closed-loop control during normal operation, and in which, when a defective rail pressure sensor is detected, the operating mode is switched from normal operating mode to emergency operating mode, in which the rail pressure is then controlled by open-loop control.

In an internal combustion engine with a common rail system, the quality of combustion is critically determined by the pressure level in the rail. Therefore, in order to stay within legally prescribed emission limits, the rail pressure is automatically controlled. A closed-loop rail pressure control system typically comprises a comparison point for determining a control deviation, a pressure controller for computing a control signal, the controlled system, and a software filter in the feedback path for computing the actual rail pressure. The control deviation is computed as the difference between a set rail pressure and the actual rail pressure. The controlled system comprises the pressure regulator, the rail, and the injectors for injecting the fuel into the combustion chambers of the internal combustion engine.

DE 10 2006 040 441 B3 describes a common rail system with closed-loop pressure control, in which the pressure controller acts on a suction throttle by means of a control signal. The suction throttle in turn determines the admission cross section to the high-pressure pump and thus the volume of fuel delivered. The suction throttle is actuated in negative logic, i.e., it is completely open at a current value of zero amperes. As a protective measure against excessively high rail pressure, for example, after a cable break in the power supply to the suction throttle, a passive pressure control valve is provided. If the rail pressure rises above a critical value, for example, 2400 bars, the pressure control valve opens. The fuel is then redirected from the rail to the fuel tank through the open pressure control valve. With the pressure control valve open, a pressure level develops in the rail which depends on the injection quantity and the engine speed. Under idling conditions, this pressure level is about 900 bars, under a full load, it is about 700 bars.

DE 101 57 641 A1 describes a common rail system, in which, when a defective rail pressure sensor is detected, a change is made from normal operating mode with closed-loop pressure control to emergency operating mode, in which the rail pressure is controlled by open-loop control. In order to avoid an undefined operating state during the transition from normal operating mode to emergency operating mode, a transition function is provided. This transition function is previously determined during normal operation from the variation of the control deviation of the rail pressure with respect to time. With the end of normal operation, a negative control deviation is then assigned to the pressure controller by the transition function. As an alternative, provision can be made to preassign a correction volume flow to the controlled system. This solution has proven effective in practice, although it has been observed that, after failure of the rail pressure sensor, the rail pressure does not always swing back to the same pressure level and therefore causes different engine outputs in emergency operating mode.

SUMMARY OF THE INVENTION

Proceeding from a common rail system with closed-loop control of the rail pressure and a passive pressure control valve, the objective of the invention is to guarantee engine operation with uniform engine output following failure of the rail pressure sensor.

This objective is achieved by a method for the open-loop and closed-loop control of an internal combustion engine.

The central idea of the invention is to bring about a stable operating state in emergency operating mode after failure of the rail pressure sensor by intentional opening of the passive pressure control valve. With the pressure control valve open, the rail pressure in turn is between the pressure value during idle, e.g., 900 bars, and the pressure value at full load, e.g., 700 bars. Uniform engine output in emergency operation is thus realized by virtue of the fact that the rail pressure during emergency operation is always within this pressure range. This provides the advantage of stable emergency operation.

In a common rail system with a suction throttle on the low-pressure side as the pressure regulator, successive pressure increase in the rail in emergency operating mode is realized by acting on suction throttle in the opening direction, which then allows the high-pressure pump to pump more fuel.

In a first embodiment of this idea, either a set current or a PWM signal is set to a suitable emergency operating value as the triggering signal of the suction throttle. In a second embodiment, a changeover of the characteristic curve is made from a pump characteristic curve in normal operating mode to a limit curve in emergency operating mode. In a supplementary refinement, it is provided that when the change is made to emergency operating mode, the set current is computed as a function of a leakage volume flow. This is computed by a leakage input-output map as a function of the set injection quantity and the engine speed.

To make it possible to operate the internal combustion engine with high output even in emergency operating mode, the energization time of the injectors is also adjusted. In normal operation, the energization time is computed by an input-output map as a function of the set injection quantity and the actual rail pressure. When the rail pressure sensor is defective, a mean rail pressure is set as the input variable for the input-output map instead of the actual rail pressure. The mean rail pressure is preassigned as a constant value. If the pressure level in the rail with the passive pressure control valve open is, for example, 900 bars during idle and 700 bars at full load, then the mean rail pressure is set at 800 bars.

Naturally, the procedure of the invention can also be used in a common rail system with an electrically controllable high-pressure pump. In this case, when a defective rail pressure sensor is detected, the high-pressure pump is set to maximum output during emergency operation.

BRIEF DESCRIPTION OF THE DRAWING

The figures illustrate preferred embodiments of the invention based on a common rail system with a suction throttle.

DETAILED DESCRIPTION OF THE INVENTION

Figure 1:
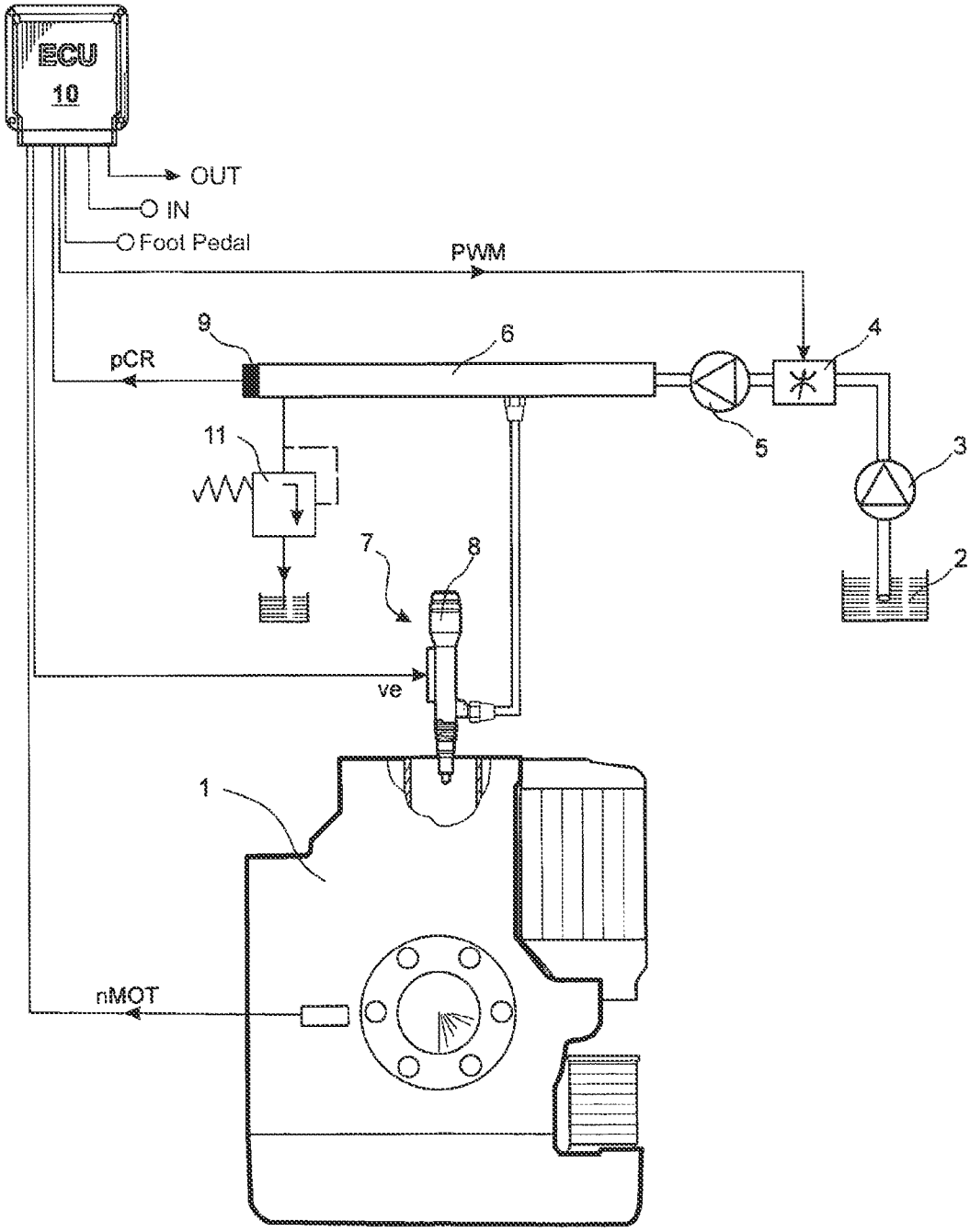
FIG. 1 is a system diagram.

FIG. 1 shows a system diagram of an electronically controlled internal combustion engine 1 with a common rail system. The common rail system comprises the following mechanical components: a low-pressure pump 3 for pumping fuel from a fuel tank 2, a variable suction throttle 4 for controlling the fuel volume flow flowing through the lines, a high-pressure pump 5 for pumping the fuel at increased pressure, a rail 6 for storing the fuel, and injectors 7 for injecting the fuel into the combustion chambers of the internal combustion engine 1. Optionally, the common rail system can also be realized with individual accumulators, in which case an individual accumulator 8 is integrated, for example, in the injector 7 as an additional buffer volume. To protect against an impermissibly high pressure level in the rail 6, a passive pressure control valve 11 is provided, which opens, for example, at a rail pressure of 2400 bars and, in its open state, redirects the fuel from the rail 6 into the fuel tank 2.

The operating mode of the internal combustion engine 1 is determined by an electronic control unit (ECU) 10. The electric control unit 10 contains the usual components of a microcomputer system, for example, a microprocessor, interface adapters, buffers, and memory components (EEPROM, RAM). Operating characteristics that are relevant to the operation of the internal combustion engine 1 are applied in the memory components in the form of input-output maps/characteristic curves. The electronic control unit 10 uses these to compute the output variables from the input variables. FIG. 1 shows the following input variables as examples: the rail pressure pCR, which is measured by means of a rail pressure sensor 9, an engine speed nMOT, a signal FP, which represents an engine power output desired by the operator, and an input variable IN, which represents additional sensor signals, for example, the charge air pressure of an exhaust gas turbocharger. FIG. 1 also shows the following as output variables of the electronic control unit 10: a PWM signal for controlling the suction throttle 4, a signal ve for controlling the injectors 7 (injection start/injection end), and an output variable OUT. The output variable OUT is representative of additional control signals for the open-loop and closed-loop control of the internal combustion engine 1, for example, a control signal for activating a second exhaust gas turbocharger during a register supercharging.

Figure 2:
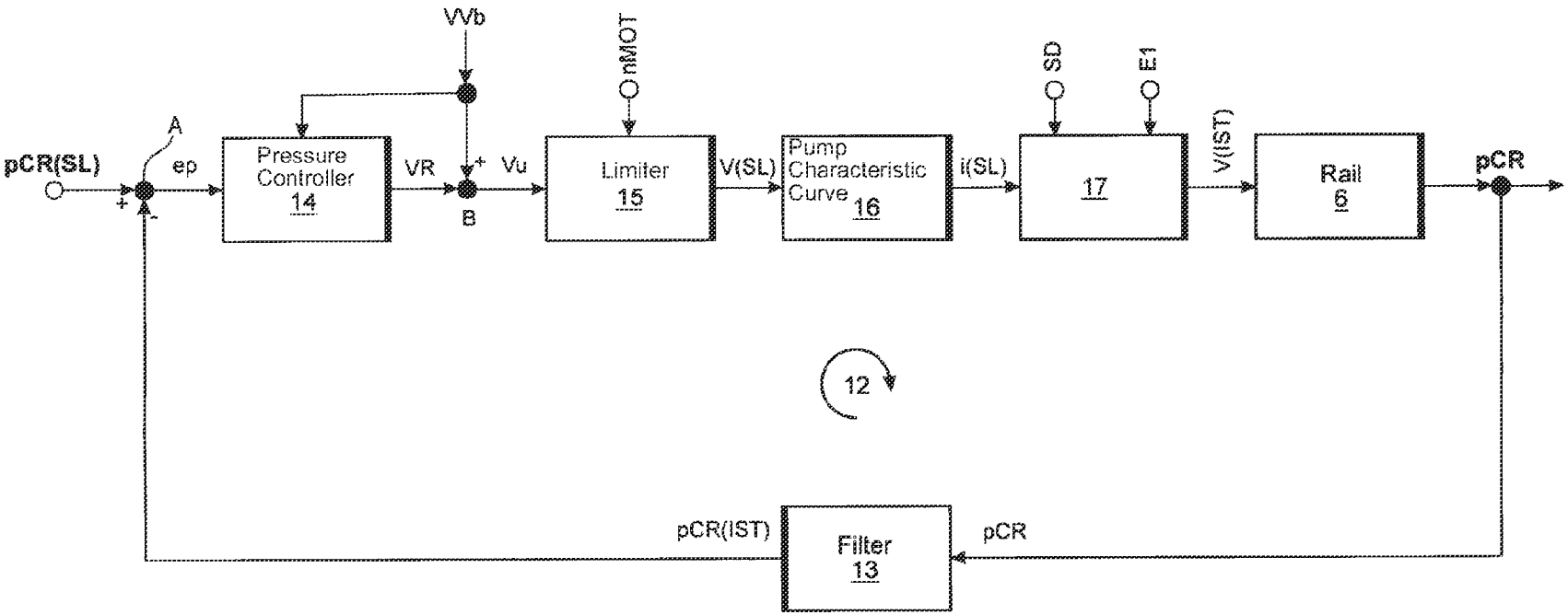
FIG. 2 is a first embodiment of a closed-loop rail pressure control system.
Figure 3:
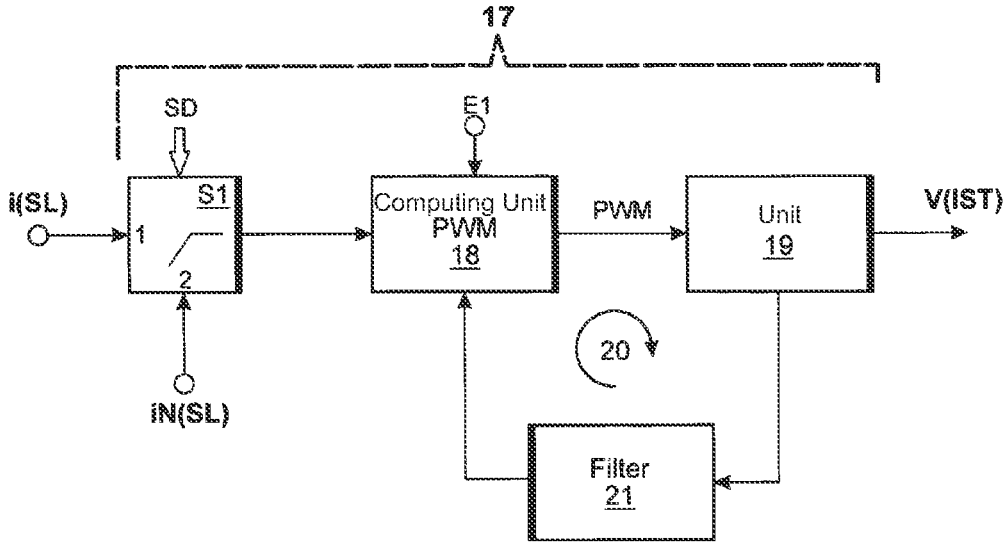
FIG. 3 is a first block diagram.
Figure 4:
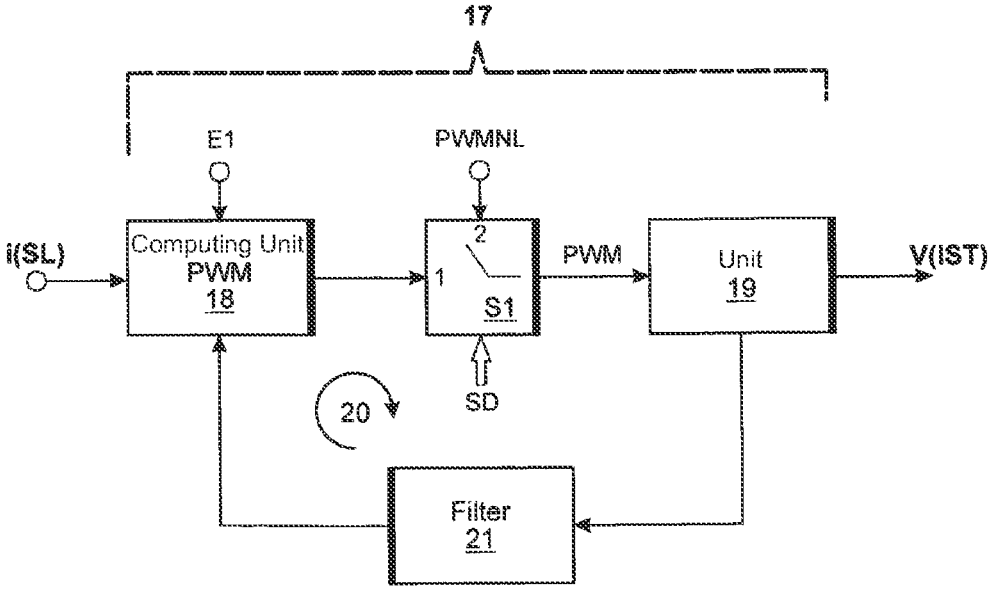
FIG. 4 is a second block diagram.
Figure 8:
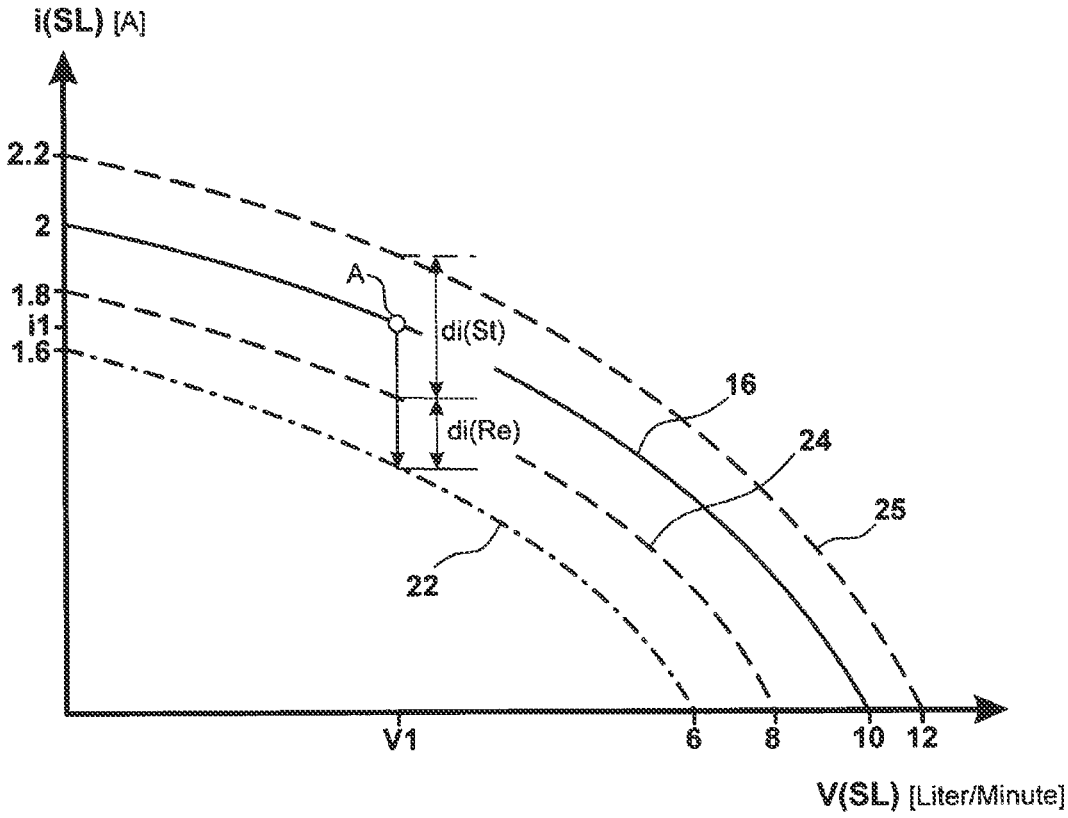
FIG. 8 is a pump characteristic with limit curve.

FIG. 2 shows a first embodiment of a closed-loop rail pressure control system 12 for the closed-loop control of the rail pressure pCR. The input variables of the closed-loop rail pressure control system 12 are: a set rail pressure pCR(SL), a set consumption VVb, the engine speed nMOT, a signal SD, and a variable E1. The signal SD is set when an error function of the rail pressure sensor is detected. The variable E1 combines, for example, the PWM base frequency, the battery voltage, and the ohmic resistance of the suction throttle coil with lead-in wire, which enter into the computation of the PWM signal. The output variable of the closed-loop rail pressure control system 12 is the raw value of the rail pressure pCR. The actual rail pressure pCR(IST) is computed from the raw value of the rail pressure pCR by means of a filter 13. The actual rail pressure pCR(IST) is then compared with the set rail pressure pCR(SL) at a summation point A, and a control deviation ep is obtained from this comparison. A correcting variable is computed from the control deviation ep by a pressure controller 14. The correcting variable represents a controller volume flow VR with the physical unit of liters/minute. The computed set consumption VVb is added to the controller volume flow VR at a summation point B. The set consumption VVb is computed as a function of a set injection quantity and the engine speed. The result of the addition at summation point B represents an unlimited volume flow Vu, which is then limited by a limiter 15 as a function of the engine speed nMOT. The output variable of the limiter 15 represents a set volume flow V(SL), which is the input variable of a pump characteristic curve 16. The pump characteristic curve 16 assigns an electrical set current i(SL) to the set volume flow V(SL). The pump characteristic curve is shown in FIG. 8 and will be explained in greater detail in connection with the description of FIG. 8. The set current i(SL) is one of the input variables of a functional block 17, which combines the computation of the PWM signal and the switching of the operation to emergency operation. Functional block 17 is shown in FIGS. 3 and 4 and will be explained in connection with the description of these figures. The output variable of functional block 17 represents the actual volume flow V(IST) pumped by the high-pressure pump 5 into the rail 6. The pressure level pCR in the rail is detected by the rail pressure sensor. The closed-loop rail pressure control system 12 is thus closed.

FIG. 3 shows functional block 17 of FIG. 2 in a first block diagram. The functional block 17 determines the PWM signal for activating the suction throttle and the switching of the triggering signal of the suction throttle from normal operation to emergency operation. The input variables of functional block 17 here are the set current i(SL), a set emergency operating current iN(SL), the signal SD, and the input variable E1. The variable E1 combines the PWM base frequency, the battery voltage, and the ohmic resistance of the suction throttle coil with lead-in wire. The output variable of functional block 17 is the actual volume flow V(IST) that is actually pumped into the rail. The elements of functional block 17 are a switch S1, a computing unit 18 for the PWM signal and high pressure pump and suction throttle combined as unit 19. In normal operating mode, the switch S1 is in position 1, i.e., the PWM signal PWM is computed by the computing unit 18 as a function of the set current i(SL). The PWM signal PWM then acts on the solenoid of the suction throttle. The displacement of the magnetic core is varied in this way, so that the delivery flow of the high-pressure pump is freely controlled. For safety reasons, the suction throttle is open in the absence of current and with increasing PWM value is caused to move in the direction of the closed position. A closed-loop current control system 20 can be subordinate to the PWM signal computing unit 18, as described in DE 10 2004 061 474 A1.

If a defective rail pressure sensor is now detected, the signal SD is set, which causes the switch S1 to switch to position 2. The PWM signal PWM is now computed as a function of the set emergency operating current iN(SL). The set emergency operating current iN(SL) is chosen in such a way that the passive pressure control valve 11 (FIG. 1) opens reliably. If, as previously described, the suction throttle is actuated in negative logic, the passive pressure control valve 11 opens reliably if the emergency operating current is set to the value iN(SL)=0 A. However, opening of the passive pressure control valve can also be effected if the set emergency operating current iN(SL) is set in a somewhat higher value, for example, iN(SL)=0.4 A. This has the advantage that the greater fuel throttling does not lead to as much heating of the fuel as it is redirected into the fuel tank.

FIG. 4 shows the functional block 17 of FIG. 2 in a second block diagram as an alternative to the embodiment shown in FIG. 3. The input variables of the functional block 17 of FIG. 4 are the set current i(SL), a PWM emergency operating value PWMNL, the signal SD, and the input variable E1. Here again, the output variable of functional block 17 is the actual volume flow V(IST) that is actually pumped into the rail. The elements of functional block 17 are the computing unit 18 for the PWM signal, a switch S1, and the high-pressure pump and suction throttle combined as unit 19. In normal operating mode, the switch S1 is in position 1, i.e., the PWM signal PWM is computed by the computing unit 18 as a function of the set current i(SL). The PWM signal PWM then acts on the solenoid of the suction throttle (unit 19). If a defective rail pressure sensor is now detected, the signal SD is set, which causes the switch S1 to switch to position 2. The suction throttle is now acted upon with the PWM emergency operating value PWMNL. The PWM emergency operating value PWMNL is chosen in such a way that the passive pressure control valve 11 (FIG. 1) opens reliably. If, as previously described, the suction throttle is actuated in negative logic, the passive pressure control valve 11 opens reliably if the PWM emergency operating value is set to 0%. However, opening of the passive pressure control valve can also be effected if a somewhat higher value is chosen, for example, PWMNL=5%. Here again, this has the advantage that the greater fuel throttling does not lead to as much heating of the fuel as it is redirected into the fuel tank.

Figure 5:
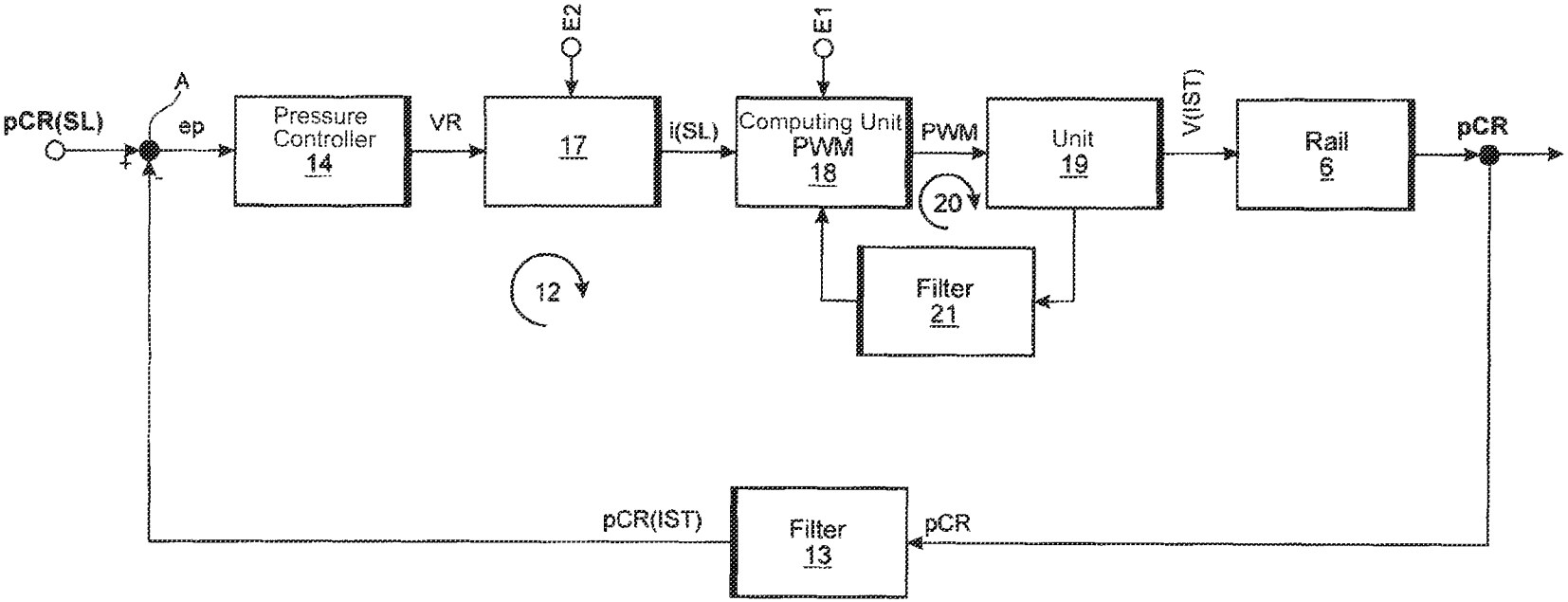
FIG. 5 is a second embodiment of a closed-loop rail pressure control system.

FIG. 5 shows a second embodiment of a closed-loop rail pressure control system 12. The input variables of the closed-loop rail pressure control system 12 are: the set rail pressure pCR(SL), the input variable E1, and an input variable E2. The variable E1 combines, for example, the PWM base frequency, the battery voltage, and the ohmic resistance of the suction throttle coil with lead-in wire, which enter into the computation of the PWM signal. The input variable E2 combines, for example, the set consumption VVb, the engine speed nMOT, and a set injection quantity. The output variable of the closed-loop rail pressure control system 12 is the raw value of the rail pressure pCR. The actual rail pressure pCR(IST) is computed from the raw value of the rail pressure pCR by means of the filter 13. The actual rail pressure pCR(IST) is then compared with the set value pCR(SL) at a summation point A, and a control deviation ep is obtained from this comparison. A correcting variable is computed from the control deviation ep by a pressure controller 14. The correcting variable represents a controller volume flow VR with the physical unit of liters/minute. The controller volume flow VR is one input variable of the functional block 17. Among other things, the pump characteristic curve and the switching from normal operating mode to emergency operating mode are integrated in the functional block 17. Functional block 17 will be explained in greater detail in connection with the description of FIGS. 6 and 7. The output variable of functional block 17 represents the set current i(SL), which is one of the input variables of the computing unit 18 for the PWM signal. A closed-loop current control system 20 with filter 21 can be subordinate to the PWM signal computing unit 18. The PWM signal PWM then acts on the suction throttle, which is combined with the high-pressure pump in the unit 19. The output variable of unit 19 actual volume flow V(IST) pumped into the rail 6 by the high-pressure pump. The pressure level pCR in the rail is detected by the rail pressure sensor. The closed-loop rail pressure control system 12 is thus closed.

Figure 6:
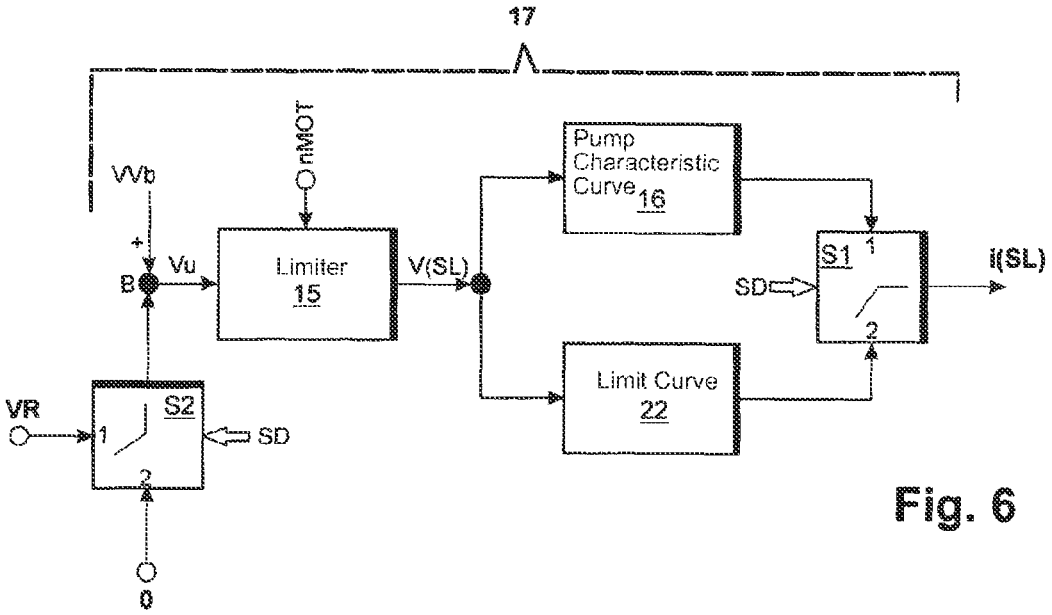
FIG. 6 is a first block diagram.

FIG. 6 shows the functional block 17 of FIG. 5 in a first block diagram. When there is a failure of the rail pressure sensor, a switch is made from the pump characteristic curve to the limit curve. The input variables of the functional block 17 are the controller volume flow VR, which is the correcting variable of the pressure controller, the set consumption VVb, the engine speed nMOT, and the signal SD. The output variable is the set current i(SL). The output of the switch S2 and the set consumption VVb are added at a summation point B. The result represents the unlimited set volume flow Vu, which is then limited by the limiter 15 as a function of the engine speed nMOT. The output variable represents the set volume flow V(SL), which is the input variable of both the pump characteristic curve 16 and the limit curve 22. In normal operating mode, the switch S1 is in position 1, which in turn means that the set current i(SL) is determined by the pump characteristic curve 16. If a defective rail pressure sensor is now detected, the signal SD is set, which causes the switch S1 to switch to position 2. The set current i(SL) is now determined by the limit curve 22. The pump characteristic curve 16 and the limit curve 22 are shown in FIG. 8 and will be explained in greater detail in the discussion of FIG. 8. The embodiment shown in FIG. 6 minimizes heating of the fuel. If the signal SD is set, the switch S2 switches from position 1 to position 2. This causes the controller volume flow VR to be replaced by the value zero.

Figure 7:
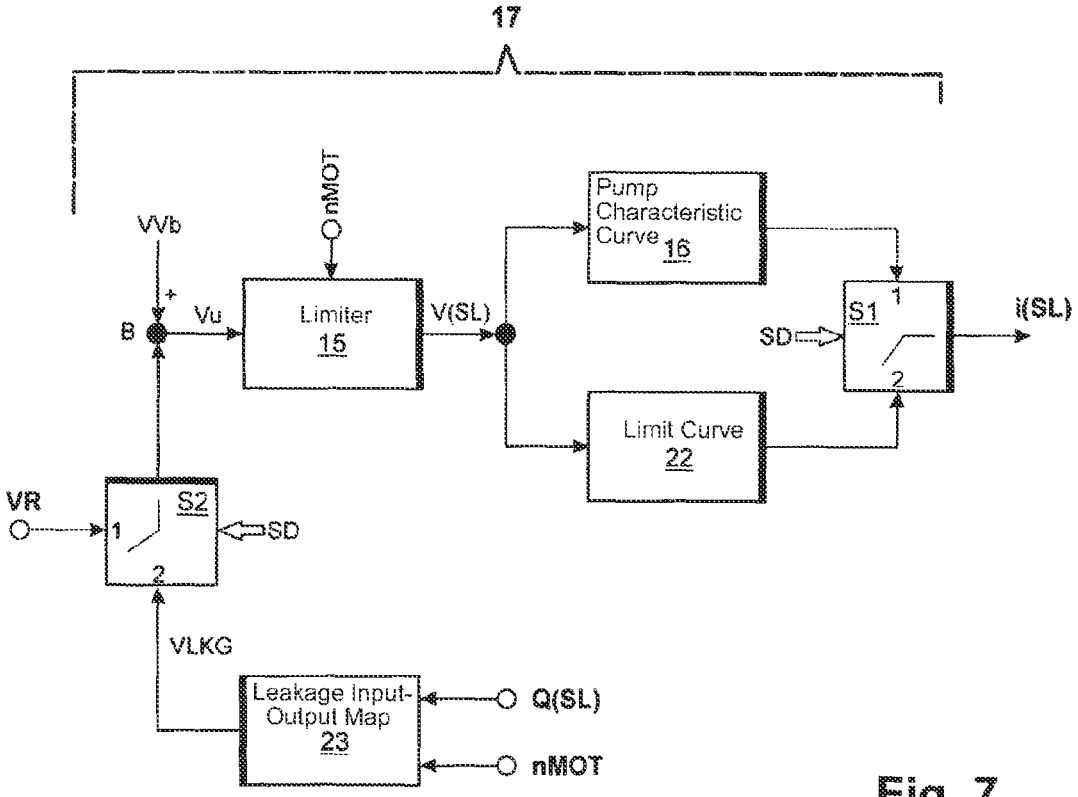
FIG. 7 is a second block diagram.

FIG. 7 shows the functional block 17 of FIG. 5 in a second block diagram. Compared to FIG. 6, the functional block is supplemented by a leakage input-output map 23 with the set injection quantity Q(SL) as an additional input variable. In normal operating mode, switches S1 and S2 are in position 1. Therefore, the set current i(SL) is computed by the pump characteristic curve 16 as a function of the set volume flow V(SL). The set volume flow V(SL) in turn is determined from the unlimited set volume flow Vu, which corresponds to the sum of the controller volume flow VR and the set consumption VVb. If a defective rail pressure sensor is now detected, the signal SD is set, which causes the switches S1 and S2 to switch to position 2. In position 2 of switch S2, the correcting variable of the pressure controller (here: the controller volume flow VR) is no longer determining for the unlimited set volume flow Vu, which is now computed from the sum of the set consumption VVb and a leakage volume flow VLKG. The leakage volume flow VLKG in turn is computed by the leakage input-output map 23 as a function of the set injection quantity Q(SL) and the engine speed nMOT. A leakage input-output map and its determination are described in DE 101 57 641 A1, to which reference is herewith made. In position 2 of the switch S1, the set current i(SL) is computed by the limit curve 22.

FIG. 8 shows the pump characteristic curve 16 and the limit curve 22 together in one diagram to facilitate explanation. The set volume flow V(SL) in liters/minute is plotted on the x-axis. The set current i(SL) in amperes is plotted on the y-axis. The pump characteristic curve 16 is plotted as a solid line. The pump characteristic curve 16 assigns to a given set volume flow V(SL) a corresponding set current i(SL). For example, the set current i(SL)=i1 is assigned to the set volume flow V(SL)=V1 via the operating point A. Since in practice there is a great deal of variation from one high-pressure pump to another, the pump characteristic curve 16 is actually an average pump characteristic curve. The two characteristic curves 24 and 25, which are shown as broken lines, represent the range of variation within which the high-pressure pumps must lie. For example, for a set volume flow V(SL)=V1, we obtain a variation di(ST) of the set current i(SL). The limit curve 22 is drawn as a dot-dash line. This curve is obtained as a means of allowing for a reserve by shifting the pump characteristic curve 24 towards smaller set current values, i.e., in the direction of the x-axis. For the set volume flow V1, a reserve di(Re) in the energization is obtained in this way. All together, the limit curve 22 represents an assignment of the set volume flow V(SL) to those maximum values of the set current i(SL) which reliably allow opening of the pressure control valve.

Figure 9:
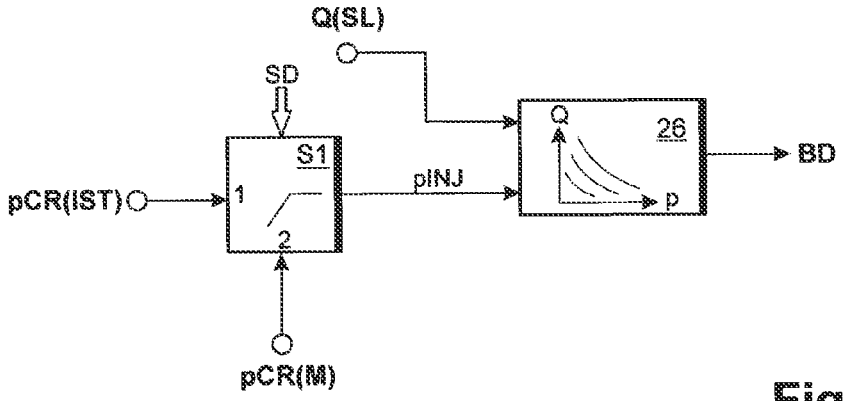
FIG. 9 is a block diagram for computing the energization time.

FIG. 9 shows a block diagram for computing the energization time BD. The energization time BD is obtained here as the output variable of a three-dimensional injector input-output map 26. The input variables are the set injection quantity Q(SL) and a pressure pINJ. In normal operating mode, the switch S1 is in position 1, so that the pressure pINJ is identical with the actual rail pressure pCR(IST). In the event of a failure of the rail pressure sensor, the signal SD causes the switch S1 to change over to position 2. The pressure pINJ is now set to a mean rail pressure pCR(M). The mean rail pressure pCR(M) represents the rail pressure that develops, on average, when the pressure control valve opens. If, for example, a rail pressure of 900 bars develops during idling, and a rail pressure of 700 bars develops at full load, then the mean rail pressure is pCR(M)=800 bars. The mean rail pressure pCR(M) is thus a very good approximation of the actual rail pressure. The energization time BD can thus be computed with sufficient accuracy even if the rail pressure sensor fails. It is advantageous that the internal combustion engine can thus be operated with very high output even in emergency operating mode.

Figure 10A:
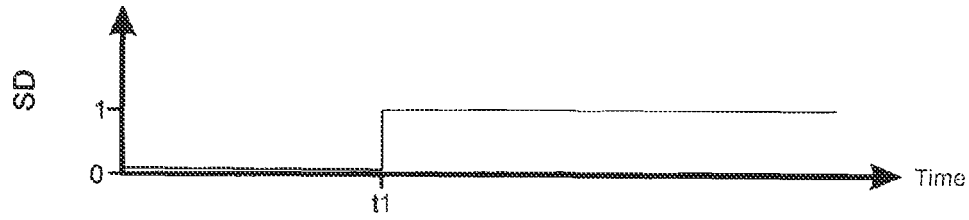
FIG. 10 is a time chart.
Figure 10B:
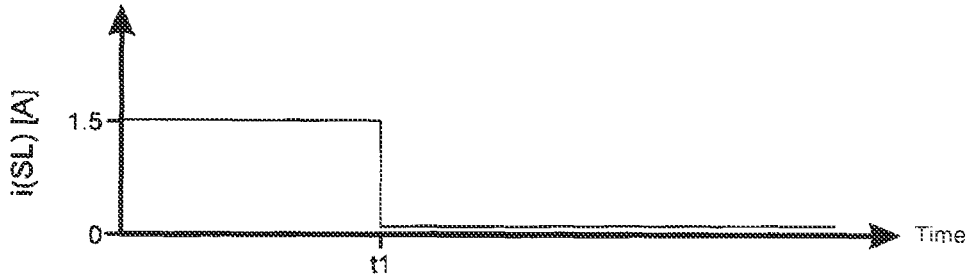
Figure 10C:
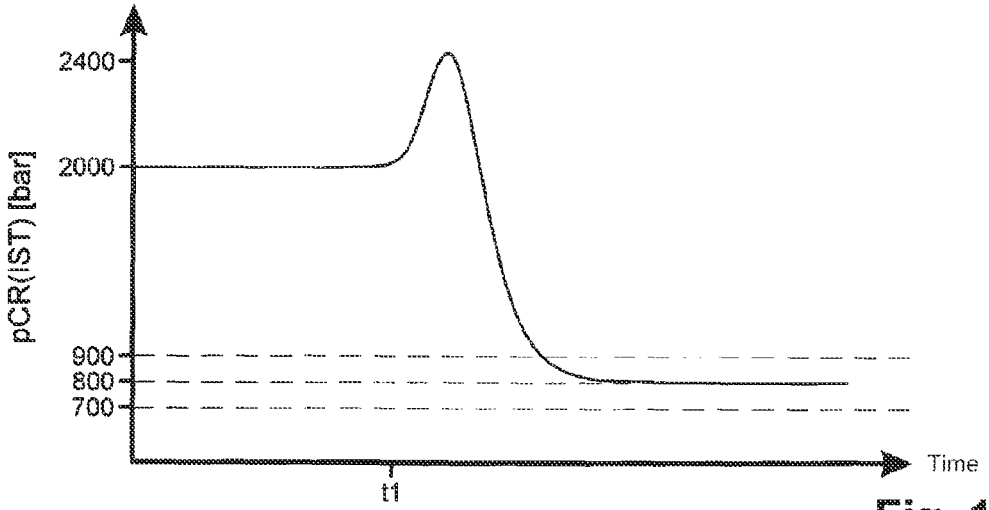
Figure 10D:
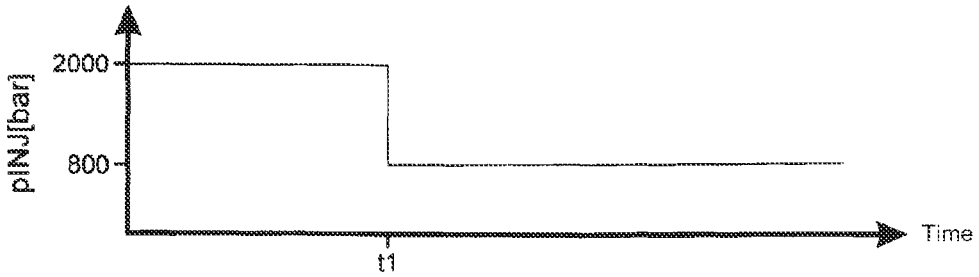

FIG. 10 shows a time chart that comprises four separate graphs 10A to 10D, which show the following as a function of time: the signal SD in FIG. 10A, the set current i(SL) in FIG. 10B, the actual rail pressure pCR(IST) in FIG. 10C, and the pressure pINJ as the input variable of the injector input-output map in FIG. 10D. At time t1, the defect of the rail pressure sensor occurs, i.e., the signal SD is to the value 1. When the defect is detected, the set current i(SL) is changed from the original value i(SL)−1.5 A to the value i(SL)=0 A. In the unenergized state, the suction throttle is fully opened, so that the high-pressure pump pumps the maximum possible amount of fuel. This has the effect that the actual rail pressure pCR(IST) successively rises from the pressure level at time t1 until the opening pressure of the pressure control valve is reached. The opening pressure here is 2400 bars (FIG. 10C). Once the pressure control valve has opened, the actual rail pressure pCR(IST) drops and gradually levels out at a pressure level between 700 bars and 900 bars. Likewise at time t1, the input variable pINJ of the injector input-output map switches from the actual rail pressure pCR(IST) at time t1 (here: pCR(IST)=2000 bars) to the mean rail pressure pCR (M) (here: 800 bars). See FIG. 10D.

Figure 11:
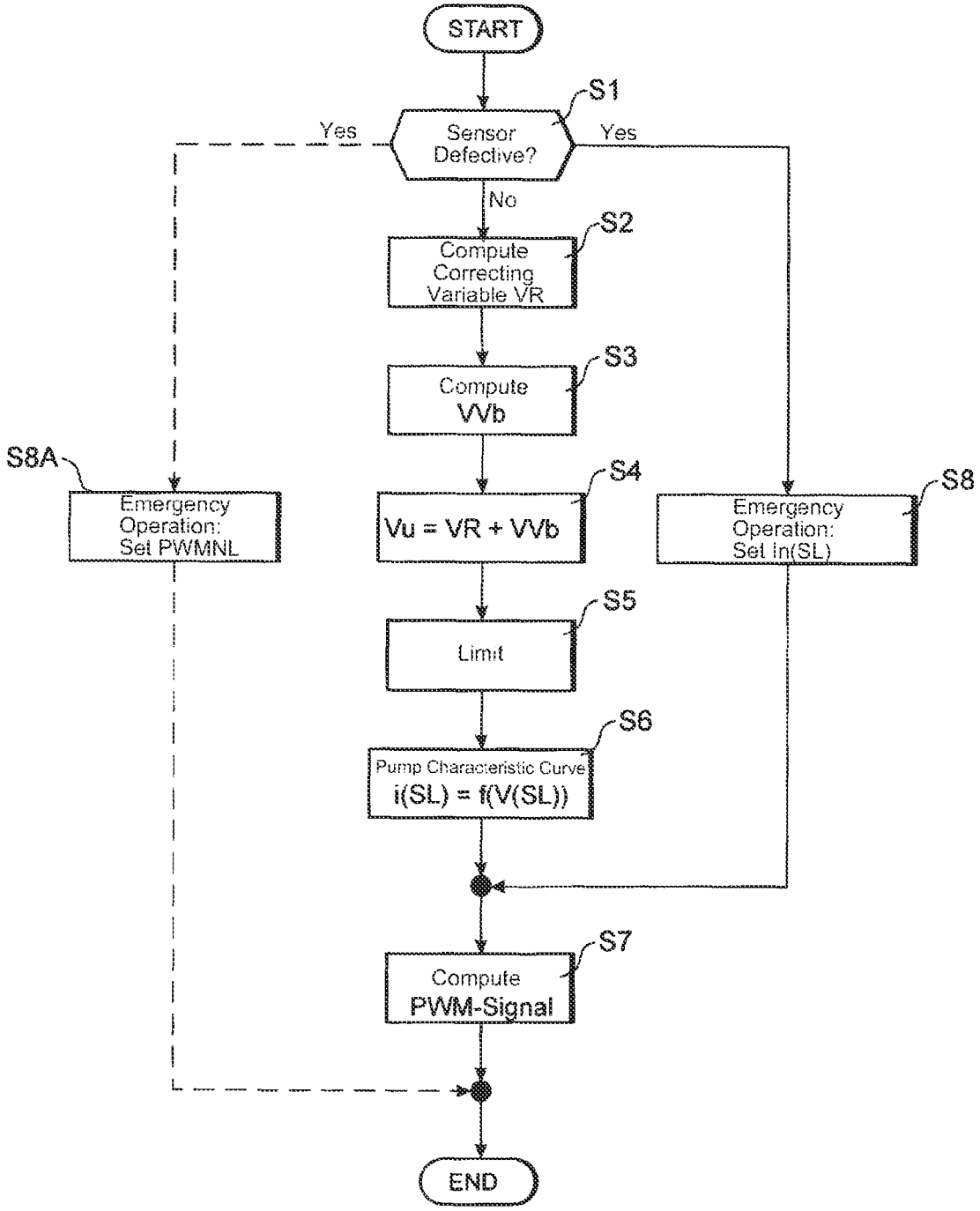
FIG. 11 is a program flowchart for the first embodiment.

FIG. 11 shows a program flowchart of a subroutine that corresponds to the embodiment according to FIGS. 2 to 4. At S1 a test is carried out to determine whether the rail pressure sensor is defective. If this is not the case (interrogation result S1: no), the routine with the steps S2 to S6 is executed. Otherwise, the emergency operating mode is activated. If a correctly operating rail pressure sensor was determined at S1, then at S2 the pressure controller uses the control deviation of the rail pressure to compute the controller volume flow VR as a correcting variable. At S3 the set consumption VVb is determined from the set injection quantity and the engine speed, and then at S4 the unlimited set volume flow Vu is computed by addition. At S5 the unlimited set volume flow Vu is then limited as a function of the engine speed and set as the set volume flow V(SL). At S6 a set current i(SL) is assigned to the set volume flow V(SL) by the pump characteristic curve, and at S7 the set current i(SL) is used to compute a PWM signal for activating the suction throttle. The subroutine is then ended. If a defective rail pressure sensor was detected at S1, a changeover is made to emergency operating mode at S8 by setting the set current i(SL) to the set emergency operating current iN(SL), for example, iN(SL)=0 A. Then at S7 the PWM signal is computed from the set emergency operating current iN(SL), and the subroutine is ended. In FIG. 11, a broken line is used to indicate an alternative step S8A, in which the PWM signal is set to the PWM emergency operation value PWMNL. FIG. 4 corresponds to this alternative.

Figure 12:
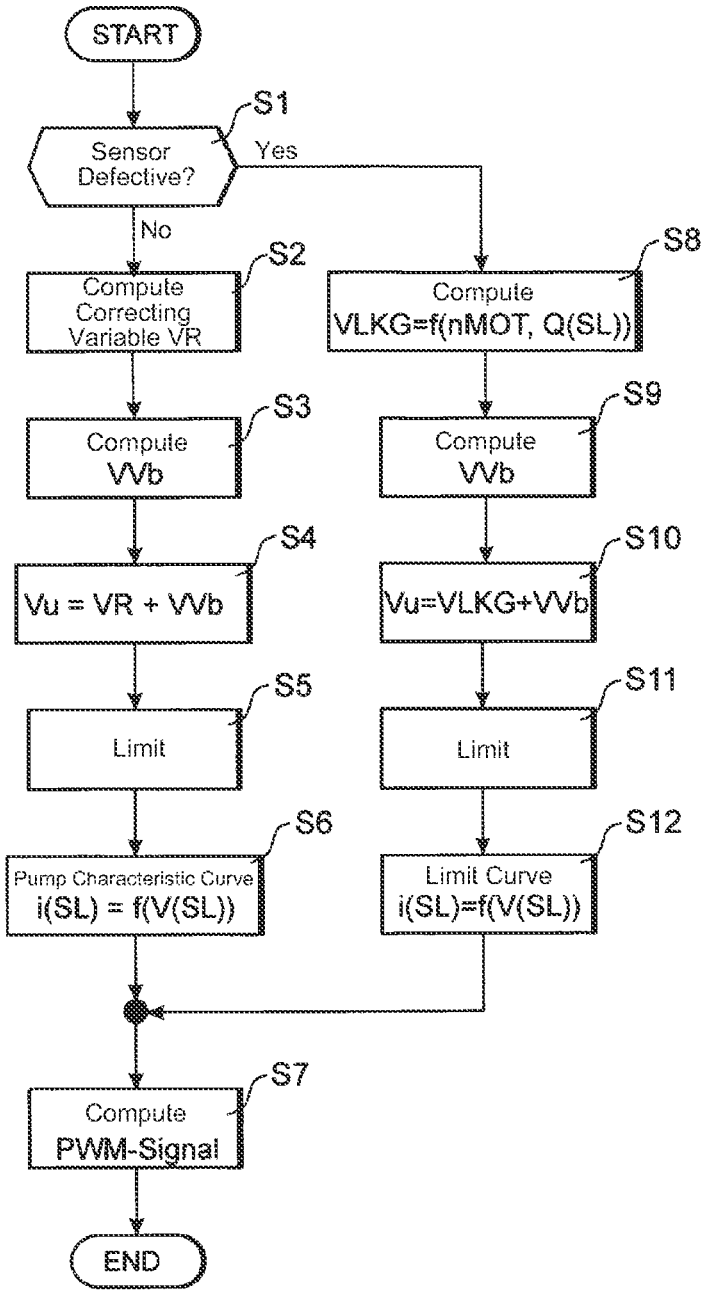
FIG. 12 is a program flowchart for the second embodiment.

FIG. 12 shows a program flowchart of a subroutine that corresponds to the embodiment according to FIGS. 5 to 7. At S1 a test is carried out to determine whether the rail pressure sensor is defective. If this is not the case (interrogation result S1: no), the routine with the steps S2 to S6 is executed. Otherwise, the emergency operating mode is activated. The steps S2 to S6 correspond to the steps S2 to S6 in FIG. 11, i.e., the normal operating mode, so that what was said there applies equally here. If a defective rail pressure sensor was detected at S1 (interrogation result S1: yes), then at S8 a leakage volume flow VLKG is computed by a leakage input-output map as a function of the set injection quantity Q(SL) and the engine speed nMOT. At S9 the set consumption VVb is determined and then at S10 the unlimited set volume flow Vu is computed as the sum of the leakage volume flow VLKG and the set consumption VVb. At S11 the unlimited set volume flow Vu is limited as a function of the engine speed and set as the set volume flow V(SL). Then at S12 the set current i(SL) is computed by the limit curve and is then used at S7 to determine the PWM signal for activating the suction throttle. The subroutine is then ended.

LIST OF REFERENCE NUMBERS

1 internal combustion engine
2 fuel tank
3 low-pressure pump
4 suction throttle
5 high-pressure pump
6 rail
7 injector
8 individual accumulator (optional)
9 rail pressure sensor
10 electronic control unit (ECU)
11 pressure control valve, passive
12 closed-loop rail pressure control system
13 filter
14 pressure controller
15 limiter
16 pump characteristic curve
17 functional block
18 computing unit for PWM signal
19 unit (suction throttle and high-pressure pump)
20 closed-loop current control system
21 filter
22 limit curve
23 leakage input-output map
24 characteristic curve
25 characteristic curve
26 injector input-output map

The invention claimed is:

1. A method for open-loop and closed-loop control of an internal combustion engine, comprising the steps of: controlling rail pressure by closed-loop control during normal operation; and, if a defective rail pressure sensor is detected, changing from normal operating mode to emergency operating mode, in which the rail pressure is raised to switch a passive pressure control valve, which in an open position redirects fuel from the rail into a fuel tank, including determining a set current, which serves as a triggering signal of ire a suction throttle, by a pump characteristic curve in normal operating mode and in the emergency operating mode the rail pressure is controlled in that the set current is determined by a limit curve whereby in emergency operating mode, the rail pressure is successively increased up to response of the passive pressure control valve.

2. The method in accordance with claim 1, including, in emergency operating mode, determining the set current by the limit curve at least as a function of a set consumption of fuel.

3. The method in accordance with claim 1, including, in emergency operating mode, determining the set current by the limit curve as a function of a leakage volume flow, which is computed by a leakage input-output map as a function of the injection quantity and engine speed.

4. The method in accordance with claim 1, including, in emergency operating mode, determining energization time of an injector as a function of a set injection quantity and a mean rail pressure.

5. The method in accordance with claim 4, including preassigning the mean rail pressure as a constant value.

* * * * *